US011670226B1

(12) United States Patent
Wu et al.

(10) Patent No.: US 11,670,226 B1
(45) Date of Patent: Jun. 6, 2023

(54) MICRO-LIGHT-EMITTING DIODE DISPLAY PANEL HAVING A PLURALITY OF DRIVERS CONNECTED BY BUFFERS

(71) Applicants: Prilit Optronics, Inc., Tainan (TW); Himax Technologies Limited, Tainan (TW)

(72) Inventors: Biing-Seng Wu, Tainan (TW); Tzung-Ren Wang, Tainan (TW); Hsin-Hung Chen, Tainan (TW)

(73) Assignees: Prilit Optronics, Inc., Tainan (TW); Himax Technologies Limited, Tainan (TW)

( * ) Notice: Subject to any disclaimer, the term of this patent is extended or adjusted under 35 U.S.C. 154(b) by 0 days.

(21) Appl. No.: 17/717,293

(22) Filed: Apr. 11, 2022

(51) Int. Cl.
*G09G 3/32* (2016.01)

(52) U.S. Cl.
CPC ..... *G09G 3/32* (2013.01); *G09G 2310/0291* (2013.01); *G09G 2310/08* (2013.01)

(58) Field of Classification Search
CPC ..... G09G 3/32
USPC ..... 345/55
See application file for complete search history.

(56) References Cited

U.S. PATENT DOCUMENTS

| | | | | |
|---|---|---|---|---|
| 11,189,220 | B1 * | 11/2021 | Zheng | G09G 3/32 |
| 2010/0045655 | A1 * | 2/2010 | Jang | G09G 3/20 345/213 |
| 2022/0044748 | A1 * | 2/2022 | Yeh | G11C 19/28 |

* cited by examiner

*Primary Examiner* — Long D Pham
(74) *Attorney, Agent, or Firm* — Donald E. Stout; Stout, Uxa & Buyan, LLP

(57) ABSTRACT

A micro-light-emitting diode (microLED) display panel includes a timing controller, and a plurality of drivers controlled by the timing controller and arranged in an order according to distance from the timing controller. Each driver includes a buffer that buffers a signal before being sent to a succeeding driver.

11 Claims, 8 Drawing Sheets

MICRO-LIGHT-EMITTING DIODE DISPLAY PANEL HAVING A PLURALITY OF DRIVERS CONNECTED BY BUFFERS

BACKGROUND OF THE INVENTION

1. Field of the Invention

The present invention generally relates to a microLED display panel, and more particularly to drivers of a microLED display panel capable of preventing signals from being attenuated or distorted while transferring through the drivers, thereby enhancing functionality and image quality of the microLED display panel.

2. Description of Related Art

A micro-light-emitting diode (microLED, mLED or μ LED) display panel is one of flat display panels, and is composed of microscopic microLEDs each having a size of 1-100 micrometers. Compared to conventional liquid crystal display panels, the microLED display panels offer better contrast, response time and energy efficiency. Although both organic light-emitting diodes (OLEDs) and microLEDs possess good energy efficiency, the microLEDs, based on group III/V (e.g., GaN) LED technology, offer higher brightness, higher luminous efficacy and longer lifespan than the OLEDs.

Due to characteristics (e.g., impedance and parasitic capacitance) of metal wires disposed on the glass substrate of the microLED display panel, signals transferred through the wires may be subject to attenuation or distortion in proportion to transfer distance. The attenuated or distorted signals may affect image displaying, thereby decreasing image quality. Moreover, the constant current source in the microLED display panel may be aging, thereby decreasing light intensity.

A need has thus arisen to propose a novel scheme to overcome drawbacks of the conventional microLED display panel.

SUMMARY OF THE INVENTION

In view of the foregoing, it is an object of the embodiment of the present invention to provide a microLED display panel capable of preventing signals from being subject to attenuation or distortion while transferring through the drivers of the microLED display panel, and capable of compensating aging in the microLED display panel.

According to one embodiment, a micro-light-emitting diode (microLED) display panel includes a timing controller and a plurality of drivers. The drivers are controlled by the timing controller and arranged in an order according to distance from the timing controller. Each driver includes a buffer that buffers a signal before being sent to a succeeding driver.

According to another embodiment, each driver includes a regulator coupled to receive a power signal from a preceding driver and accordingly generating a regulated power signal that is then sent to a succeeding driver.

According to a further embodiment, each driver includes a first constant current source and at least one second constant current source capable of providing a current greater than the first constant current source.

DETAILED DESCRIPTION OF THE INVENTION

Figure 1A:
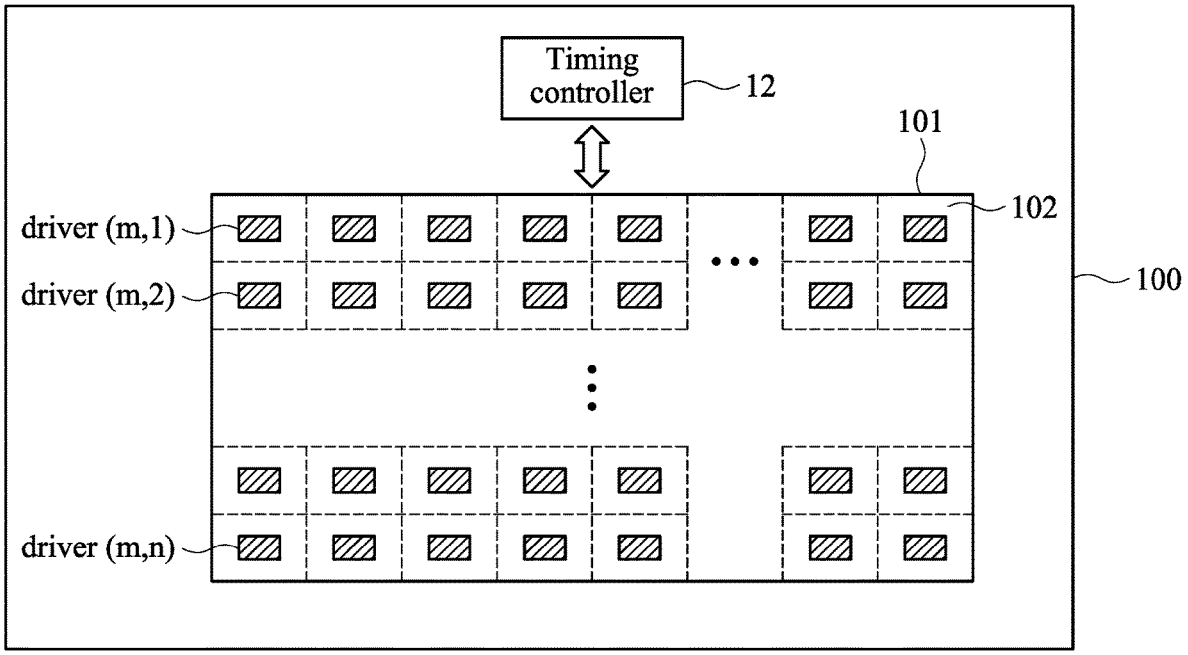
FIG. 1A schematically shows a top view illustrating a micro-light-emitting diode (microLED) display panel according to one embodiment of the present invention.

FIG. 1A schematically shows a top view illustrating a micro-light-emitting diode (microLED) display panel 100 according to one embodiment of the present invention. Specifically, a display area 101 of the microLED display panel 100 is divided into a plurality of blocks 102, each of which is driven by a corresponding driver 11 such as an integrated circuit. The microLED display panel 100 may include at least one timing controller 12 configured to control the drivers 11, which may send or receive (electrical) signals to or from the timing controller 12. In the specification, the signal may be either a digital signal or an analog signal. In one embodiment, the signal may be a transmission signal, which may be either a data signal or a control signal. In another embodiment, the signal may be a power signal (such as a voltage) related to power supply.

Figure 1B:
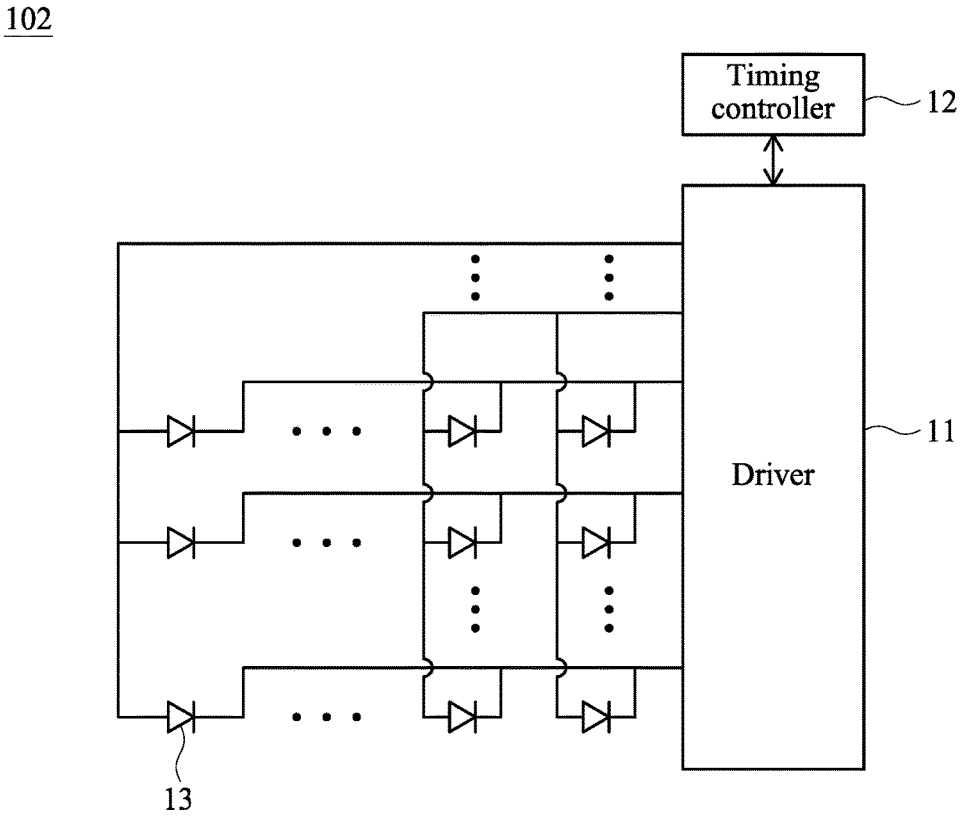
FIG. 1B shows a block diagram illustrating a block of the microLED display panel according to the embodiment of the present invention.

FIG. 1B shows a block diagram illustrating a block 102 of the microLED display panel 100 according to the embodiment of the present invention. In the embodiment, the block 102 may include a plurality of microLEDs 13 arranged in a matrix form, which are driven by the driver 11 by a passive matrix addressing scheme. Specifically, anodes of the microLEDs 13 at the same column are electrically connected to the driver 11, and cathodes of the microLEDs 13 at the same row are electrically connected to the driver 11.

Figure 2:
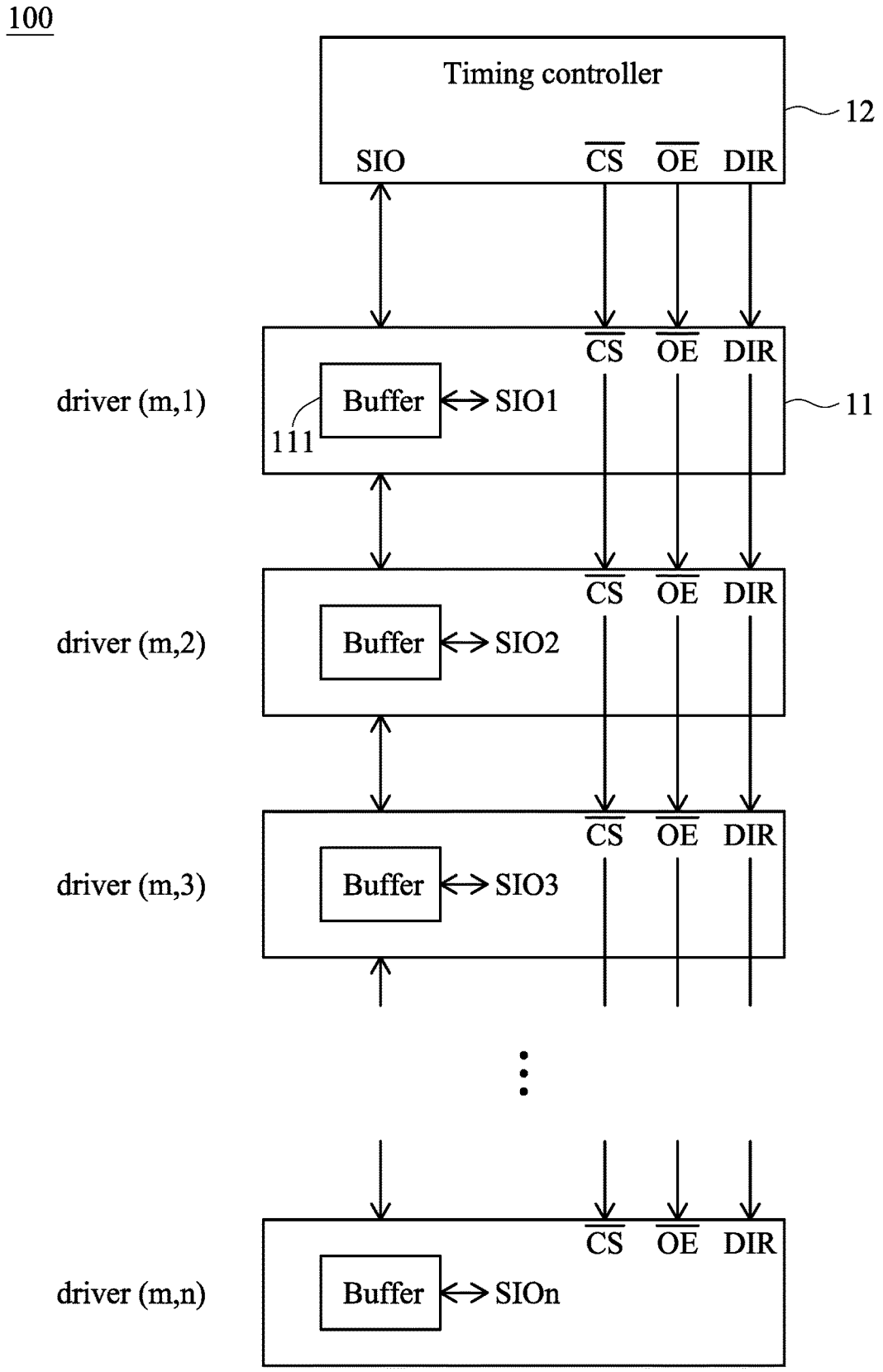
FIG. 2 shows a block diagram illustrating the microLED display panel according to a first embodiment of the present invention.

FIG. 2 shows a block diagram illustrating the microLED display panel 100 according to a first embodiment of the present invention. As exemplified in FIG. 2, a plurality of drivers 11 (for example, first to n-th drivers 11 at m-th column) are collectively controlled by the timing controller 12. It is noted that the drivers 11 are arranged in an order according to distance from the timing controller 12 such that the first driver (m,1) is nearest to the timing controller 12 and the last driver (m,n) is farthest from the timing controller 12.

In the embodiment, the drivers 11 may be selected by a chip select signal /CS (which is an active-low signal in the embodiment), and outputs of the drivers 11 may be enabled by an output enable signal /OE (which is an active-low signal in the embodiment). Further, the drivers 11 may send or receive signals (e.g., transmission signals) to or from the timing controller 12 by serial communication (or serial input/output or SIO), in which data are sequentially transferred one bit at a time. The transfer direction of signals between the drivers 11 and the timing controller 12 may be configured by a direction signal DIR. For example, signals are sent (from the driver 11) to the timing controller 12 when the direction signal DIR is high ("1"), and signals (from the timing controller 12) are received by the drivers 11 when the direction signal DIR is low ("0"). In the embodiment, the driver 11 may include a corresponding buffer 111 (e.g., a bidirectional buffer in the embodiment) configured to buffer a signal received from a neighboring driver 11. As the signal is buffered (i.e., a buffered signal) before being sent to a succeeding driver 11, the signal will not be subject to attenuation or distortion while transferring through the drivers 11.

Figure 3A:
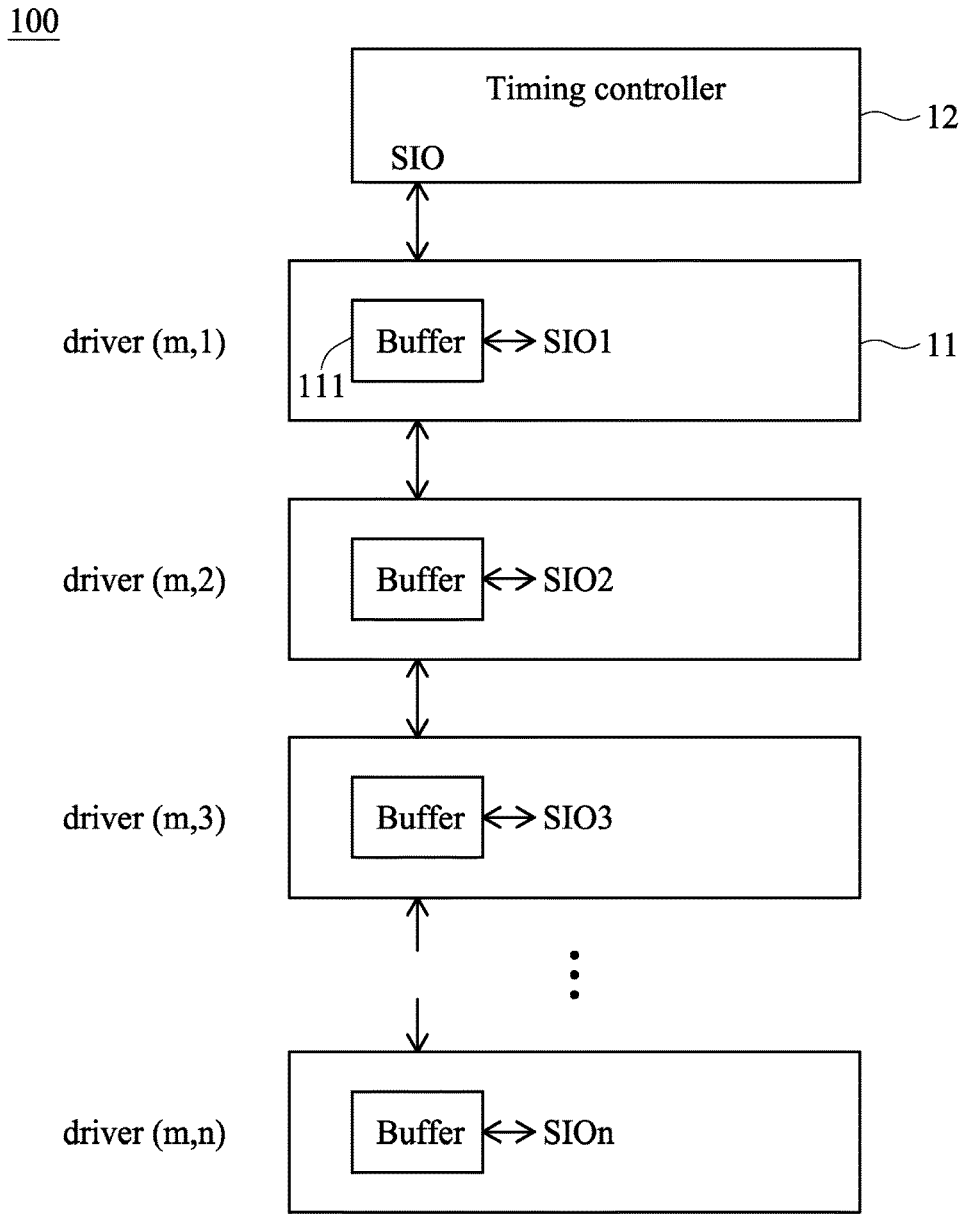
FIG. 3A shows a block diagram illustrating the microLED display panel according to an alternative first embodiment of the present invention.
Figure 3B:
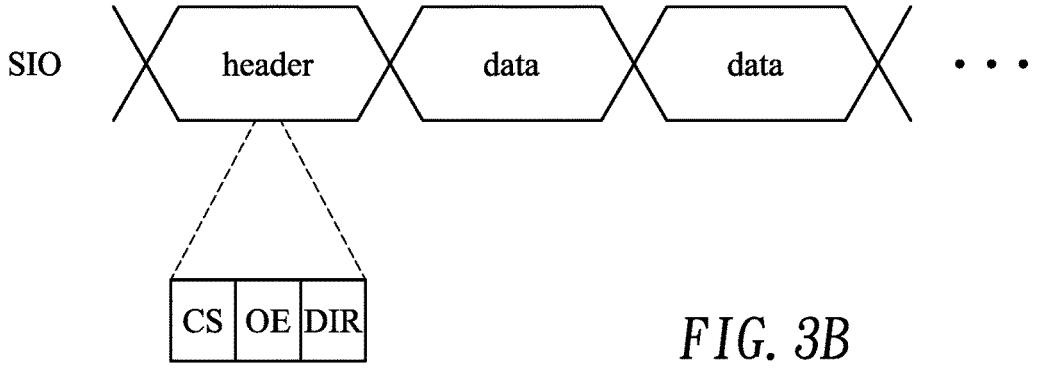
FIG. 3B shows a timing diagram of a serial-transferred signal.

FIG. 3A shows a block diagram illustrating the microLED display panel 100 according to an alternative first embodiment of the present invention, and FIG. 3B shows a timing diagram of a serial-transferred signal. In the embodiment, instead of being controlled by the chip select signal /CS, the output enable signal /OE and the direction signal DIR as in FIG. 2, chip select, the output enable and transfer direction of the drivers 11 may be configured in an header (placed at the beginning of a plurality of data) of a signal sent by the timing controller 12.

Figure 4A:
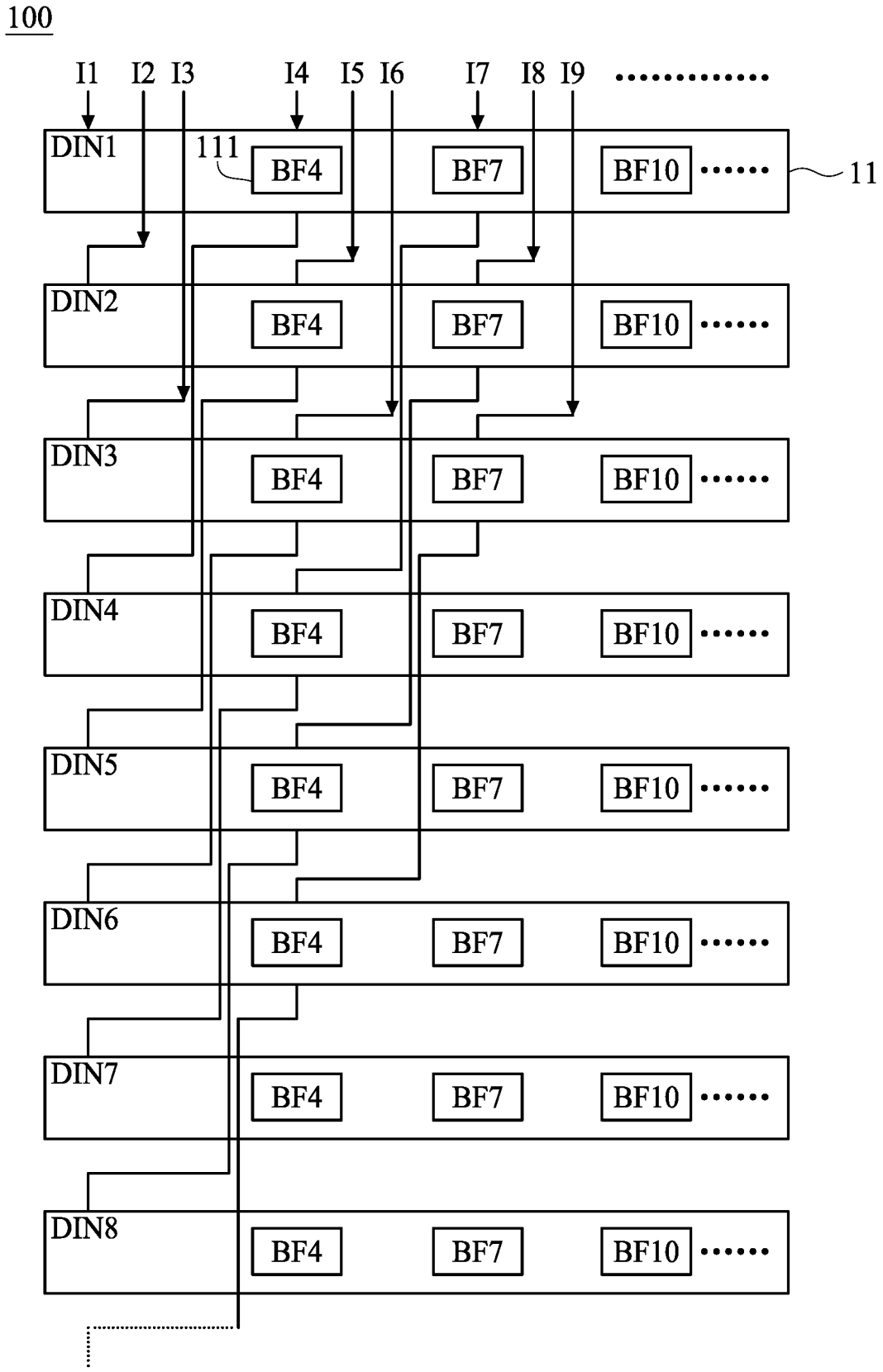
FIG. 4A and FIG. 4B show block diagrams illustrating the microLED display panel according to a second embodiment of the present invention.
Figure 4B:
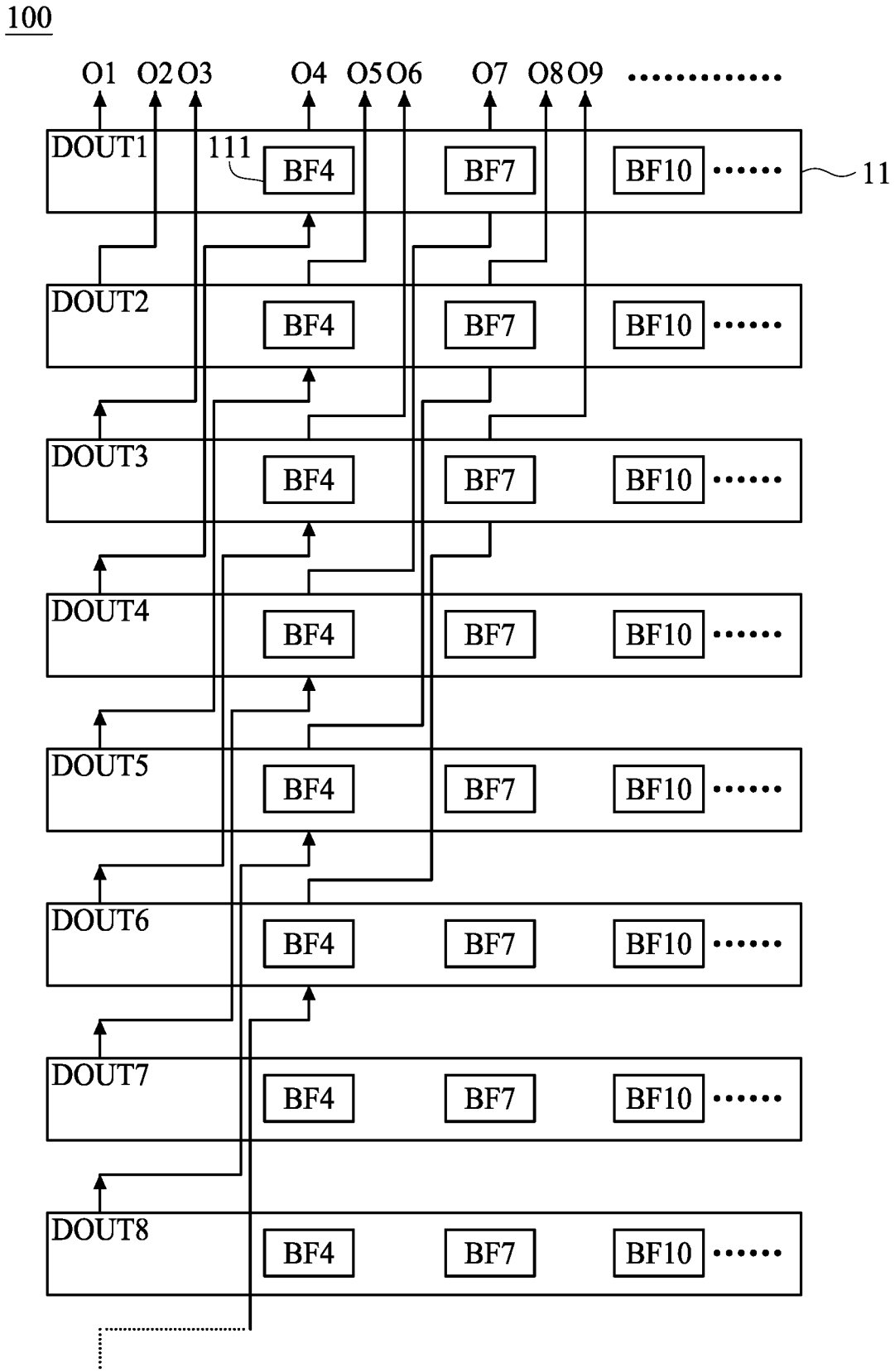

FIG. 4A and FIG. 4B show block diagrams illustrating the microLED display panel 100 according to a second embodiment of the present invention, in which signals (e.g., transmission signals I1-I9) are inputted to the drivers 11 (from the timing controller 12) by parallel communication as shown in FIG. 4A and signal (e.g., transmission signals O1-O9) are outputted from the drivers 11 (to the timing controller 12) by parallel communication as shown in FIG. 4B.

In the embodiment, signals are transferred spaced at intervals of multiple drivers 11. In other words, a buffered signal (that is buffered by the (unidirectional) buffer 111) is sent to a driver 11 not directly adjacent thereto, but with some drivers 11 in between. For example, as shown in FIG. 4A, an input signal 14 that is buffered by the buffer BF4 of the first driver 11 is sent to the fourth driver 11, instead of being sent to the adjacent second driver 11. As shown in FIG. 4B, a buffered signal of the fourth driver 11 is sent to the first driver 11 (and is then buffered and sent out as an output signal O4), instead of being sent to the adjacent third driver 11. In an alternative embodiment, the unidirectional buffer 111 may be replaced with a bidirectional buffer to facilitate bidirectional signal transfer.

Figure 5:
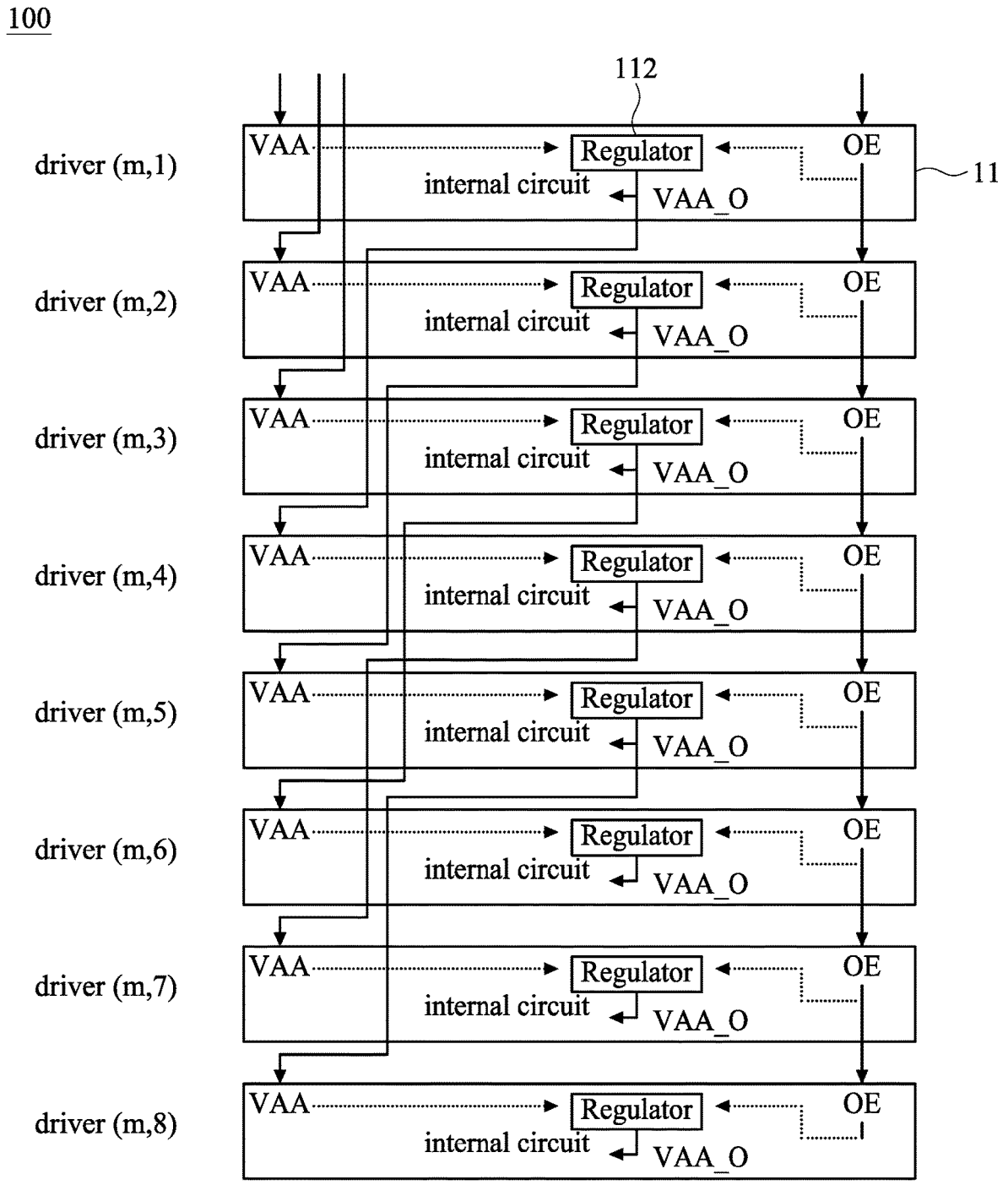
FIG. 5 shows a block diagram illustrating the microLED display panel according to a third embodiment of the present invention.

FIG. 5 shows a block diagram illustrating the microLED display panel 100 according to a third embodiment of the present invention. In the embodiment, the driver 11 may include a (power) regulator 112, such as a voltage regulator, which is coupled to receive a power signal VAA and configured to accordingly generate a regulated power signal VAA_O.

In the embodiment, power signals are transferred spaced at intervals of multiple drivers 11. In other words, a regulated power signal (that is generated by the corresponding regulator 112) is sent to a driver 11 not directly adjacent thereto, but with some drivers 11 in between. For example, as shown in FIG. 5, a regulated power signal VAA_O is sent from the first driver (m,1) to the fourth driver (m,4), instead of being sent to the adjacent second driver (m,2). As the power signal is regulated (i.e., a regulated power signal) before being sent to another driver 11, the power signal will not be subject to attenuation or distortion while transferring through the drivers 11.

Figure 6:
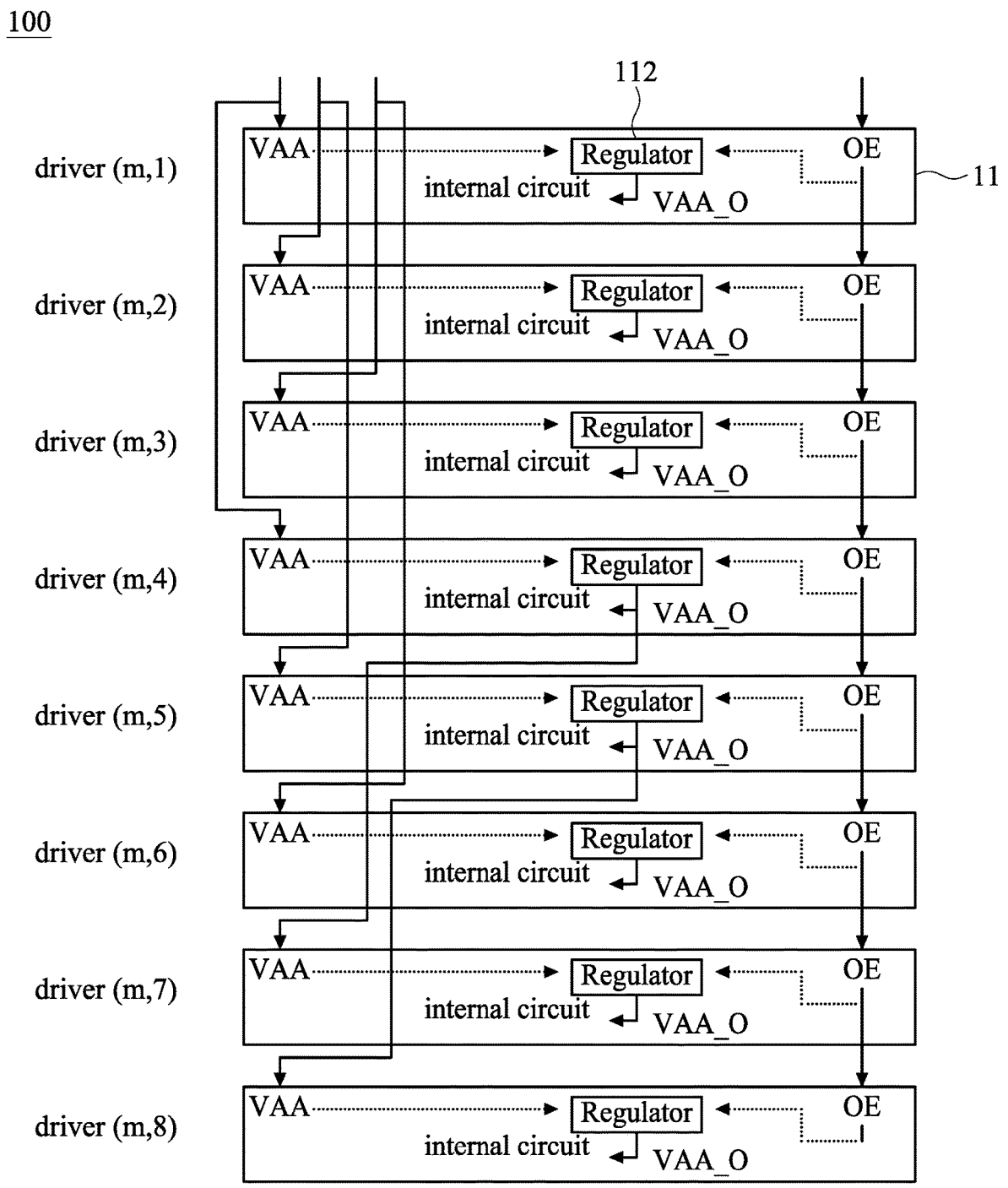
FIG. 6 shows a block diagram illustrating the microLED display panel according to an alternative third embodiment of the present invention.

FIG. 6 shows a block diagram illustrating the microLED display panel 100 according to an alternative third embodiment of the present invention. The microLED display panel 100 of FIG. 6 is similar to the microLED display panel 100 of FIG. 5 with the following exceptions.

In the microLED display panel 100 of FIG. 6, multiple power signals VAA are inputted (in parallel) to the drivers 11 at a time, while only one power signal VAA is inputted to the driver 11 at a time in the microLED display panel 100 of FIG. 5. As exemplified in FIG. 6, power signals VAA are inputted to the first driver (m,1) and the fourth drivers (m,4) at the same time, followed by sending the regulated power signal VAA_O from the fourth driver (m,4) to the seventh driver (m,7).

Figure 7A:
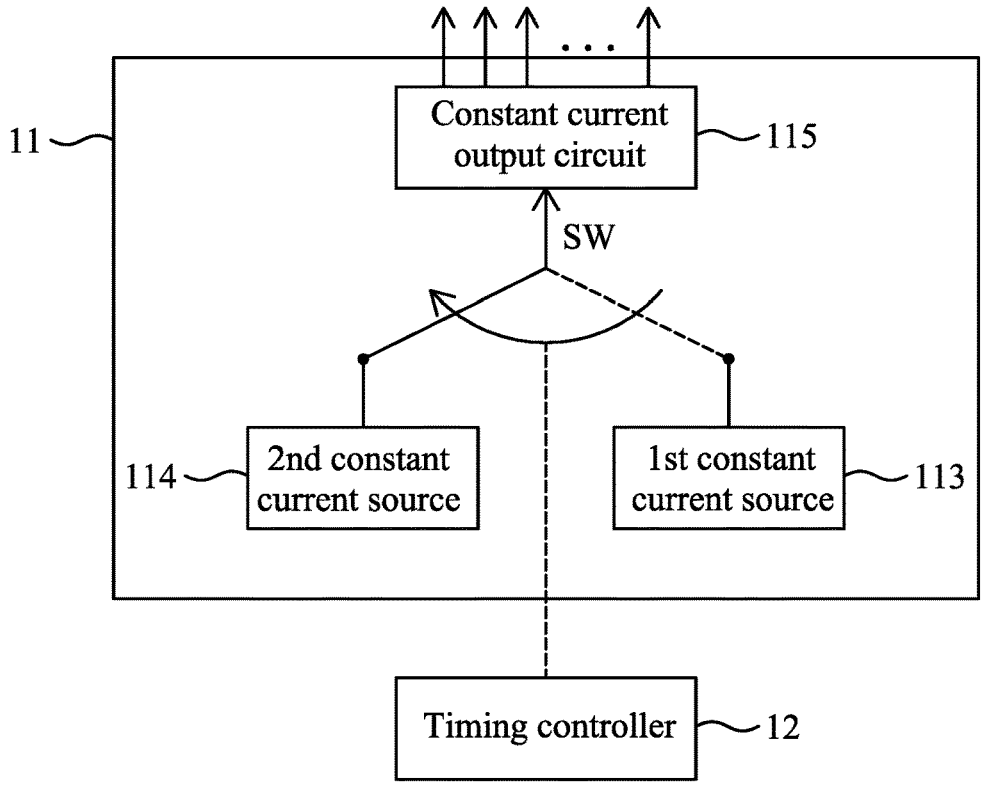
FIG. 7A shows a block diagram illustrating a driver of the microLED display panel according to a fourth embodiment of the present invention.
Figure 7B:
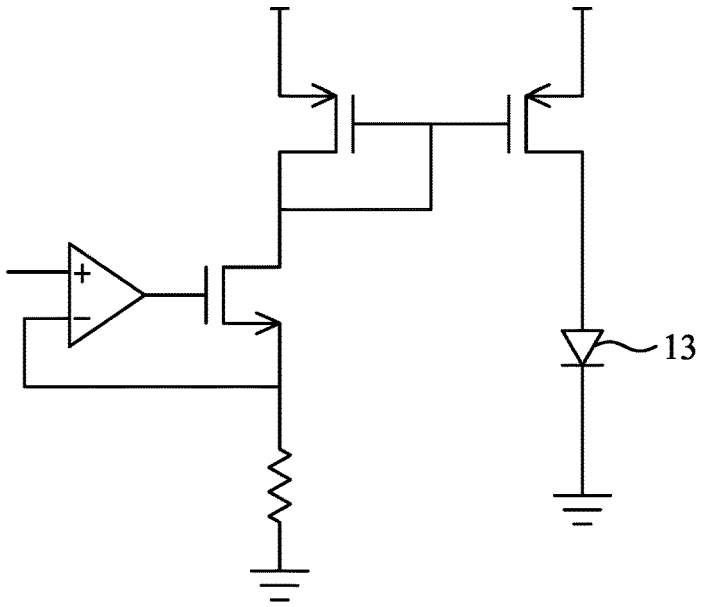
FIG. 7B shows a circuit diagram exemplifying the first constant current source and the second constant current source of the driver.

FIG. 7A shows a block diagram illustrating a driver 11 of the microLED display panel 100 according to a fourth embodiment of the present invention. Specifically, the driver 11 may include a first constant current source 113 and at least one second constant current source 114 capable of providing a current greater than the first constant current source 113. FIG. 7B shows a circuit diagram exemplifying the first constant current source 113 and the second constant current source 114 of the driver 11.

One of outputs of the first constant current source 113 and the second constant current source 114 may be selected by a switch SW (which may be controlled by the timing controller 12 or other controller), and the selected output is then fed to a constant current output circuit 115 configured to output a plurality of constant currents. Specifically, the second constant current source 114 is configured to collect aging-related parameters, such as light intensity and forward voltage, according to which design parameters for compensating the aging of the microLED display panel 100 may be obtained.

Although specific embodiments have been illustrated and described, it will be appreciated by those skilled in the art that various modifications may be made without departing from the scope of the present invention, which is intended to be limited solely by the appended claims.

What is claimed is:

1. A micro-light-emitting diode (microLED) display panel, comprising:

a timing controller; and a plurality of drivers controlled by the timing controller and arranged in an order according to distance from the timing controller;

wherein each driver includes a buffer that buffers a signal before being sent to a succeeding driver;

wherein the drivers send or receive signals to or from the timing controller by parallel communication, and the signals are transferred spaced at intervals of multiple drivers.

2. A micro-light-emitting diode (microLED) display panel, comprising:

a timing controller; and a plurality of drivers controlled by the timing controller and arranged in an order according to distance from the timing controller;

wherein each driver includes a buffer that buffers a signal before being sent to a succeeding driver;

wherein the drivers send or receive signals to or from the timing controller by serial communication, and the drivers send or receive signals to or from the timing controller by serial communication;

wherein the drivers are selected by a chip select signal, outputs of the drivers are enabled by an output enable signal, and transfer direction of the signals between the drivers and the timing controller is configured by a direction signal.

3. A micro-light-emitting diode (microLED) display panel, comprising:

a timing controller; and a plurality of drivers controlled by the timing controller and arranged in an order according to distance from the timing controller;

wherein each driver includes a buffer that buffers a signal before being sent to a succeeding driver;

wherein the drivers send or receive signals to or from the timing controller by serial communication, and the drivers send or receive signals to or from the timing controller by serial communication;

wherein chip select, output enable and transfer direction of the drivers are configured in an header of a signal sent by the timing controller.

4. The microLED display panel of claim 3, wherein the buffer receives or sends the signal from adjacent driver.

5. A micro-light-emitting diode (microLED) display panel, comprising:

a timing controller; and a plurality of drivers controlled by the timing controller and arranged in an order according to distance from the timing controller;

wherein each driver includes a regulator coupled to receive a power signal from a preceding driver and accordingly generating a regulated power signal that is then sent to a succeeding driver.

6. The microLED display panel of claim 5, wherein power signals are transferred spaced at intervals of multiple drivers.

7. The microLED display panel of claim 6, wherein multiple power signals are inputted to the drivers at a time.

8. A micro-light-emitting diode (microLED) display panel, comprising:

a timing controller;

a plurality of drivers controlled by the timing controller;

wherein each driver includes a first constant current source and at least one second constant current source capable of providing a current greater than the first constant current source.

9. The microLED display panel of claim 8, wherein the driver further includes a switch that controllably selects one of outputs of the first constant current source and the at least one second constant current source.

10. The microLED display panel of claim 9, wherein the switch is controlled by the timing controller.

11. The microLED display panel of claim 9, wherein the output selected by the switch is fed to a constant current output circuit that outputs a plurality of constant currents.

* * * * *